United States Patent [19]

Cha

[11] 4,369,842

[45] Jan. 25, 1983

[54] ANALYZING OIL SHALE RETORT OFF-GAS FOR CARBON DIOXIDE TO DETERMINE THE COMBUSTION ZONE TEMPERATURE

[75] Inventor: Chang Y. Cha, Golden, Colo.

[73] Assignee: Occidental Oil Shale, Inc., Grand Junction, Colo.

[21] Appl. No.: 232,575

[22] Filed: Feb. 9, 1981

[51] Int. Cl.[3] ..... E21B 43/243; G01N 31/12

[52] U.S. Cl. ..... 166/251; 436/28; 436/133

[58] Field of Search ..... 166/251, 250, 256, 259; 299/2, 13; 23/230 EP, 232 R

[56] References Cited

U.S. PATENT DOCUMENTS

| | | | |
|---|---|---|---|
| 3,032,102 | 5/1962 | Parker | 166/251 |
| 3,454,365 | 2/1966 | Lumpkin et al. . | |
| 3,520,363 | 7/1970 | Bauer | 166/251 |
| 3,892,270 | 7/1975 | Lindquist | 166/251 |
| 4,148,529 | 4/1979 | Burton | 166/251 X |
| 4,151,877 | 5/1979 | French | 166/259 X |
| 4,166,721 | 9/1979 | Cha . | |
| 4,249,603 | 2/1981 | Skogen | 166/251 |

OTHER PUBLICATIONS

"Thermal Decomposition Rates of Carbonates in Oil Shale", *Industrial and Engineering Chemistry*, 45, (1953), pp. 2711–2714.

*Primary Examiner*—Stephen J. Novosad

*Attorney, Agent, or Firm*—Christie, Parker & Hale

[57] ABSTRACT

An in situ oil shale retort is formed in a subterranean formation containing oil shale. The retort contains a fragmented permeable mass of particles comprising kerogen and various inorganic carbonates. A processing zone is established in the fragmented mass of formation particles and advanced therethrough. Off-gas, including carbon dioxide from carbonate decomposition, is withdrawn from the retort. The carbon dioxide content of the withdrawn off-gas, being a function of the processing zone temperature, is then determined. The determined carbon dioxide content of the withdrawn off-gas is then compared to values of carbon dioxide content of off-gas predicted as a function of processing zone temperature.

15 Claims, 4 Drawing Figures

ANALYZING OIL SHALE RETORT OFF-GAS FOR CARBON DIOXIDE TO DETERMINE THE COMBUSTION ZONE TEMPERATURE

FIELD OF THE INVENTION

This invention relates to the recovery of liquid and gaseous products from an in situ oil shale retort in a subterranean formation. More particularly, this invention relates to a method for determining the temperature of a processing zone advancing through a fragmented mass of oil shale particles in the retort.

BACKGROUND OF THE INVENTION

The presence of large deposits of oil shale in the semi-arid high plateau region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface or processing the shale in situ. The latter approach is preferable from the standpoint of environmental impact since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale as described in U.S. Pat. No. 3,661,423 includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off-gas is also withdrawn from the bottom of the retort. Such off-gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

There are several reasons why it is desirable to know the temperature of the combustion zone as it advances through an in situ oil shale retort.

It is desired to maintain the combustion zone temperature below about 2100° F. because the oil shale fuses, thereby plugging the retort when heated above this temperature.

Additionally, it can be desirable to maintain the temperature in the combustion zone above about 1400° F. to 1500° F. to take advantage of the known silication reactions which occur above such temperatures. The silication reactions can tie up soluble compounds such as magnesium oxide, calcium oxide, and other trace metal oxides in insoluble silicate materials. These silicate materials cannot be readily leached into aquifers and, therefore, eliminating such soluble metal oxides reduces the environmental impact of in situ retorting.

Yet another reason for knowing the temperature of the combustion zone is described in U.S. Pat. No. 4,171,146 issued on Oct. 16, 1979, to Robert A. Hard. This patent described the leaching of magnesium values from the spent in situ oil shale retort and discloses that careful control of the temperature of the combustion zone in the retort is an important factor in effective recovery of magnesium values by leaching.

When the combustion zone temperature is known and it is either above or below a desired temperature, such a temperature can be adjusted to the desired temperature by varying the retort inlet composition or by varying the rate of introduction of such retort inlet mixture or by other like procedure.

Standard temperature monitoring means, such as a thermocouple or resistance temperature detector system, are not desirable for use due to the corrosive atmosphere in the in situ oil shale retort during retorting. This corrosive atmosphere at the elevated temperatures of the retorting operation can cause instrument failure and overall unreliability of such systems. In addition, such systems must be installed in the oil shale rubble after the rock has been fragmented. Thermocouples or resistance temperature detectors must be connected by wire to suitable readout instruments and such connections are too fragile to withstand the effects of the rubblization blast. Such post-rubblization installation is expensive and, in some desirable locations, may be extremely difficult or even not possible with presently existing technology.

Thus, it is desirable to provide a reliable and inexpensive method for determining the temperature of a combustion zone as it advances through an in situ oil shale retort.

SUMMARY OF THE INVENTION

This invention provides a method for determining the temperature of a processing zone in an in situ oil shale retort containing a fragmented permeable mass of formation particles containing oil shale formed in a subterranean formation containing oil shale. The oil shale comprises kerogen and inorganic carbonates. Formation, either inside or adjacent the retort, is sampled for the presence, amount, and composition of inorganic carbonates contained therein. A processing zone is advanced through the fragmented mass of formation particles for producing liquid and gaseous products from the kerogen. Inorganic carbonates decompose in the processing zone, forming inorganic oxides and gaseous carbon dioxide. Off-gas, including carbon dioxide from carbonate decomposition, is withdrawn from the retort and the carbon dioxide content of the withdrawn off-gas is determined. A prediction is then made of carbon dioxide content of off-gas as a function of temperature as the processing zone moves through the retort. Thereafter, using known methods, the locus of the processing zone as it moves through the retort is determined. The determined carbon dioxide content of the withdrawn off-gas is then correlated with carbon dioxide content of off-gas predicted for anticipated processing zone temperatures at its determined locus to thereby determine the temperature of the processing zone.

The processing zone can comprise a combustion zone and/or a retorting zone.

BRIEF DESCRIPTION OF THE DRAWINGS

These and other features, aspects, and advantages of the present invention will be more fully understood by referring to the following description, appended claims, and the accompanying drawings in which:

DETAILED DESCRIPTION

Figure 1:
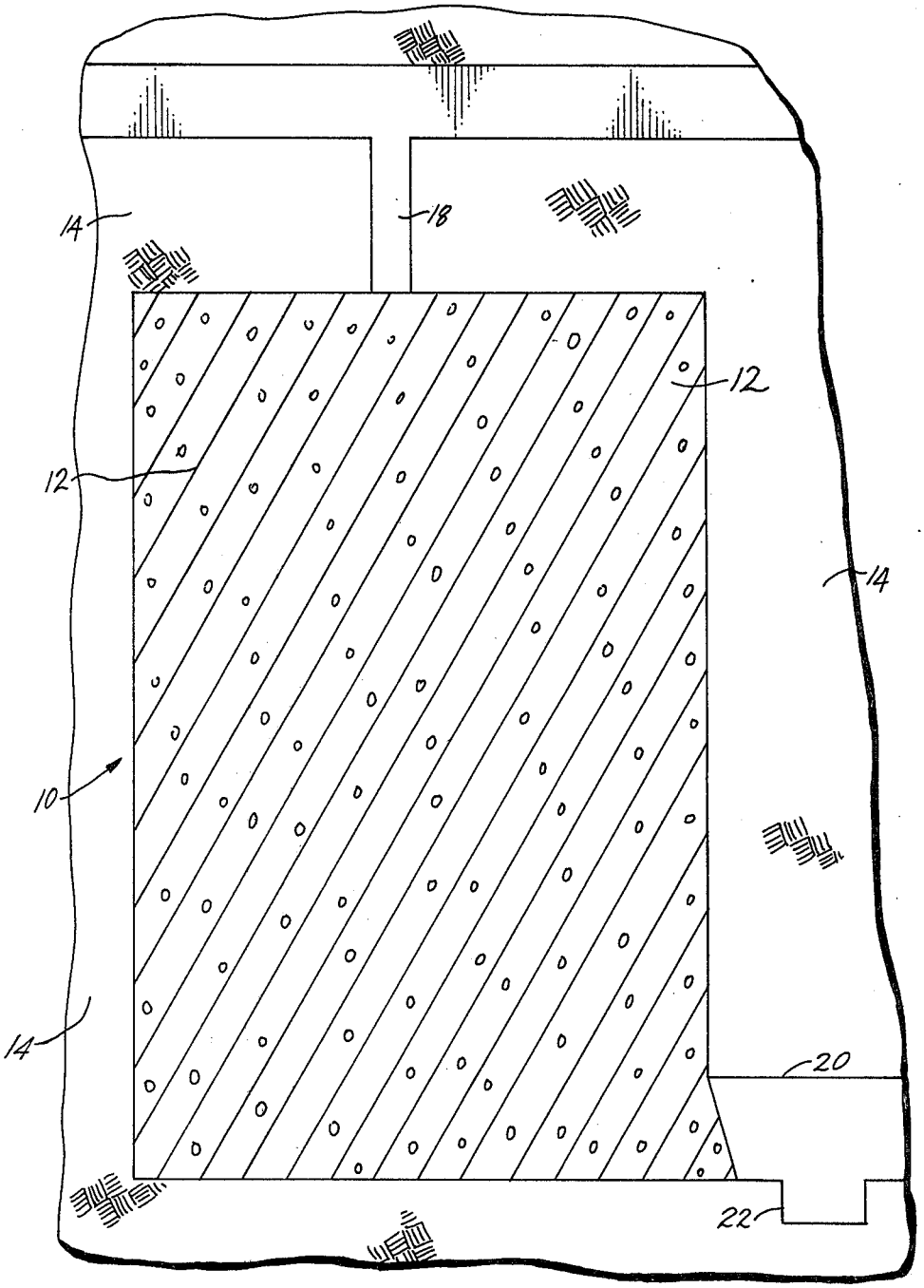
FIG. 1 is a fragmentary, semi-schematic vertical cross-sectional view of an in situ oil shale retort operated according to principles of this invention.

Referring to FIG. 1, an in situ oil shale retort 10 containing a fragmented permeable mass of formation particles 12 containing oil shale is formed in a retort site in a subterranean formation 14 containing oil shale.

A desirable technique for forming the in situ retort 10 involves excavating or mining a void within the boundaries of the retort site, while leaving zones of unfragmented formation adjacent such a void. The unfragmented formation from either one or both zones is then explosively expanded toward the void, forming the fragmented permeable mass of formation particles 12 in the in situ oil shale retort and distributing the volume formerly occupied by the void throughout the fragmented mass.

The fragmented mass of formation particles in the retort can have a void fraction of at least about 15%, preferably about 15% to about 35%. By "void fraction" there is meant the ratio of the volume of voids or spaces between particles in the fragmented mass to the total volume of the fragmented mass of particles in the retort.

Additional details of methods for forming in situ oil shale retorts are described in U.S. Pat. Nos. 3,661,423; 4,043,595; 4,043,596; 4,043,597; and 4,043,598, which are incorporated above by reference.

In an exemplary embodiment, a conduit 18 communicates with the top of the fragmented mass of formation particles 12. During retorting operations, a processing zone is established in the retort 10 and is advanced through the retort by introducing a retort inlet mixture through the conduit. The retort inlet mixture can comprise air or air enriched with oxygen, or air diluted with a fluid, such as water, steam, a fuel, a recycled off-gas, an inert gas, or combinations thereof, and the like.

The processing zone is a high temperature zone and can comprise a combustion zone and/or a retorting zone. As used herein, the term "retorting zone" refers to the portion of the retort where kerogen in oil shale is being decomposed to liquid and gaseous products, leaving residual carbonaceous material in the retorted oil shale. The term "combustion zone" refers to the portion of the retort where the greater part of the oxygen in the retort inlet mixture reacts with the residual carbonaceous material in the retorted oil shale and is consumed.

Details of techniques used for igniting oil shale particles in an in situ oil shale retort for establishing a combustion zone are disclosed in U.S. Pat. No. 4,027,917 and U.S. Pat. No. 3,952,801, both by Robert S. Burton, III and assigned to the assignee herein. These patents are incorporated herein by this reference.

The combustion zone of the present embodiment is established substantially across the entire fragmented permeable mass of oil shale particles in the retort. A retort inlet mixture is then introduced into the fragmented mass through the conduit 18 for advancing the processing zone, i.e., the combustion and retorting zones, through the retort 10. Combustion gas produced in the combustion zone and any unreacted portion of the retort inlet mixture pass through the fragmented mass of formation particles to establish the retorting zone on the advancing side of the combustion zone. Kerogen in the oil shale is retorted in the retorting zone to produce liquid and gaseous products.

The oil shale in the formation 14 can contain large quantities of inorganic carbonates, such as magnesite, brucite, dolomite (a calcium-magnesium carbonate), ferroan (an iron-magnesium carbonate), and ankerite (a form of dolomite in which there is about 15% iron substitution for magnesium). Other mineral forms, including illite, dawsonite, analcime, alagonite, calcite, quartz, potassium feldspar, sodium feldspar, nahcolite, siderite, pyrite, and fluorite, have also been identified and reported in W. Robb et al, "Mineral Profile of Oil Shales in Colorado Core Hole No. 1, Piceance Creek Basin, Colo.", *Energy Resources of the Piceance Creek Basin, Colo.*, D. Keith Murray, Ed., Rocky Mountain Association of Geologists, Denver, Colo., pages 91–100 (1974) and E. Cook, "Thermal Analysis of Oil Shales", *Quarterly of the Colorado School of Mines*, Vol. 65, pages 133–140 (1970), the disclosures of which are incorporated herein by this reference.

The thermal decomposition of carbonates of magnesium and calcium in oil shale is described in E. J. Jukkola et al, "Thermal Decomposition Rates of Carbonates and Oil Shale", *Industrial and Engineering Chemistry*, 45 (1953), pages 2711–2714, which is incorporated herein by this reference. Data obtained by heating oil shale over a range of temperatures under various partial pressures of carbon dioxide are reported. In the article, Jukkola states that dolomite in oil shale begins to decompose somewhat below 1050° F. and calcite begins to decompose in the range of from 1150° F. to 1200° F. A copy of the Jukkola article accompanies this patent application.

The extent of carbonate decomposition in oil shale has been determined to be a function, inter alia, of the temperature to which the carbonates are exposed. In addition, the decomposition reactions are rate dependent with the rate increasing as temperature increases. Thus, although other variables must be considered, the amount or concentration of carbon dioxide in off-gas from the retort can be correlated with the temperature of the processing zone advancing through the retort.

For example, several tests have been run, the results of which illustrate that the amount or concentration of carbon dioxide of off-gas from a retort is a function of the temperature in such a retort.

Figure 2:
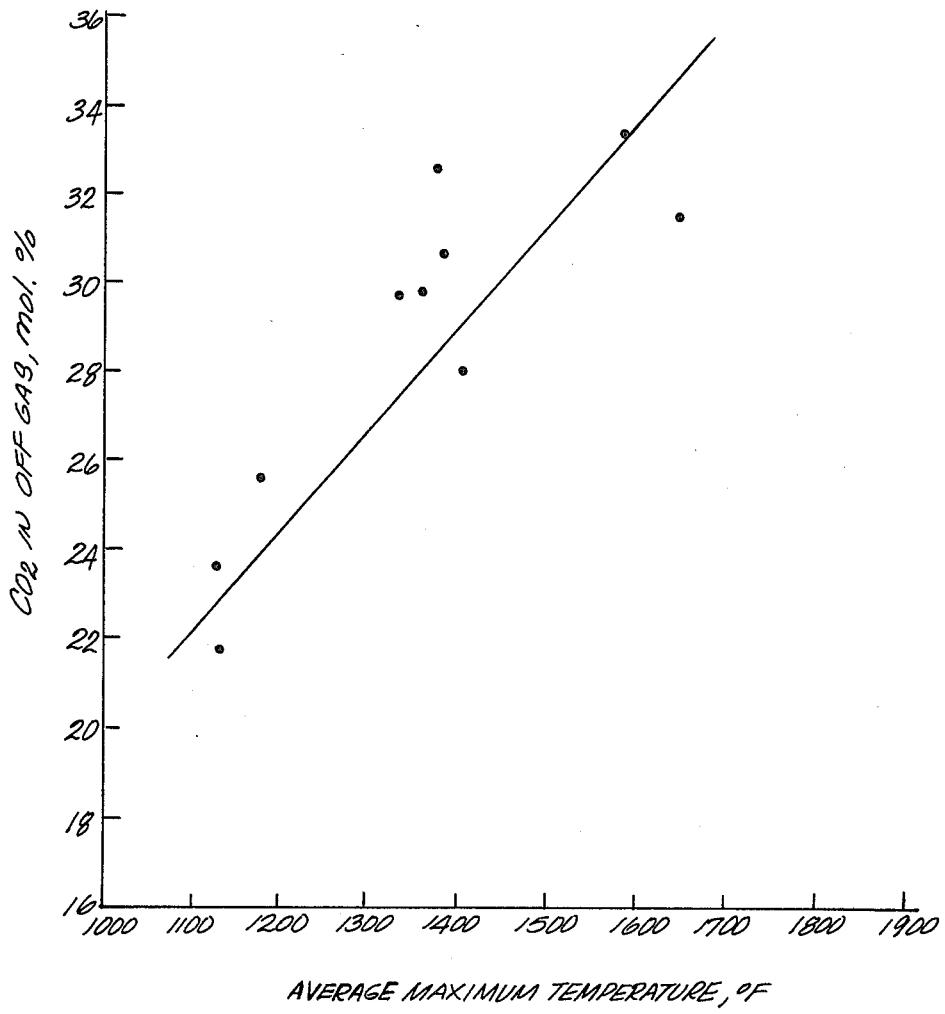
FIG. 2 is a graph of carbon dioxide content of off-gas from a retort as a function of temperature in the retort.

FIG. 2, for instance, is a graph of carbon dioxide content as Mole % of off-gas from a retort during retorting of oil shale. The carbon dioxide content was plotted against the average maximum temperature in the retort during a given period of time. This data shows a correlation between carbon dioxide content in the off-gas and a temperature in the retort.

Figure 3:
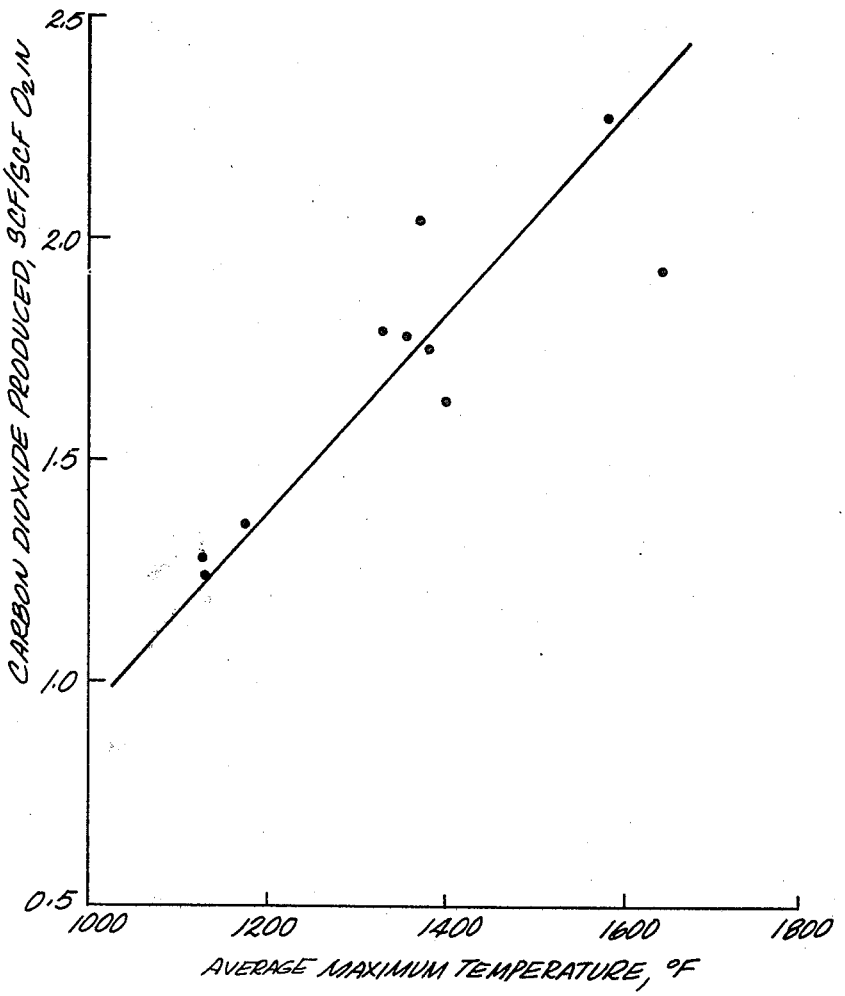
FIG. 3 is a graph of carbon dioxide content of off-gas from a retort per unit of oxygen introduced into the retort as a function of temperature in the retort.

FIG. 3 is a graph of the carbon dioxide content in off-gas from a retort per unit of oxygen in a retort inlet mixture entering the retort during retorting of oil shale. This value is plotted against the average maximum temperature in the retort for a given period of time. Again, there is a correlation shown between carbon dioxide content in off-gas and the temperature in the retort.

Figure 4:
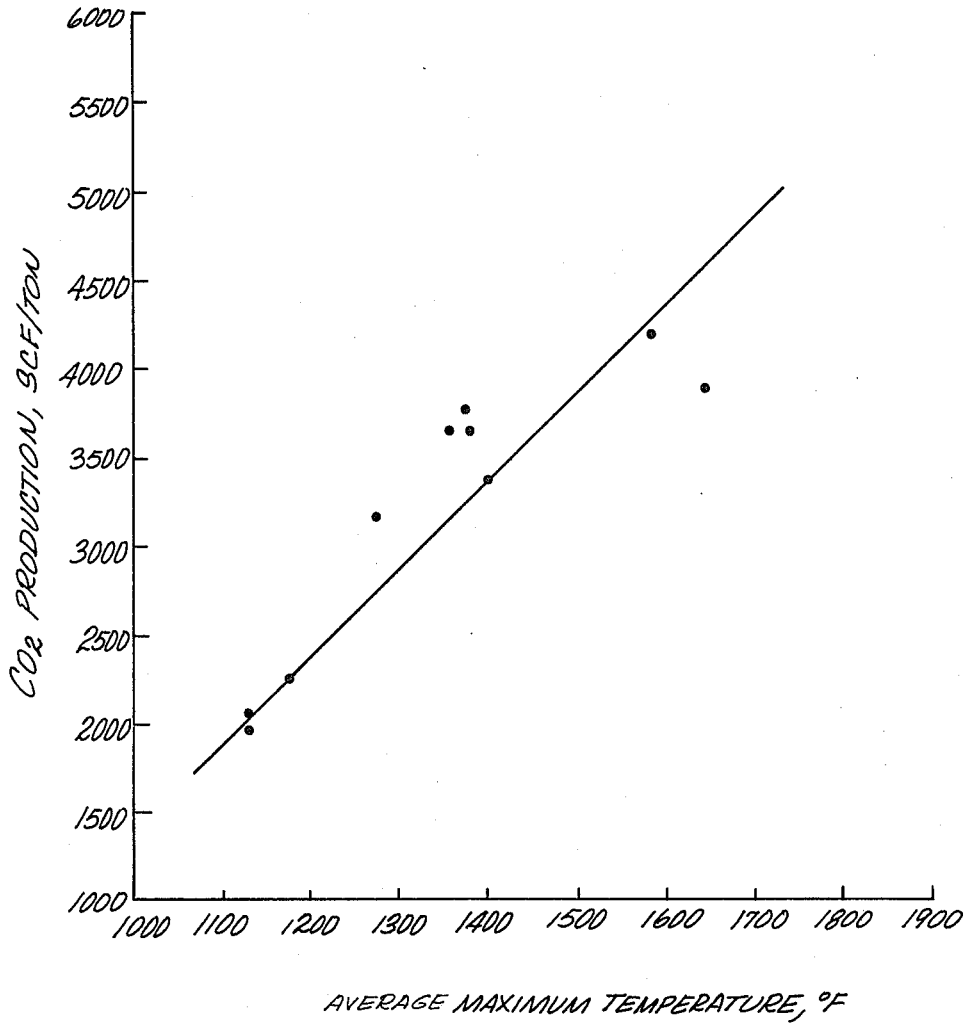
FIG. 4 is a graph of carbon dioxide content of off-gas from a retort per ton of oil shale retorted as a function of temperature in the retort.

FIG. 4 is a graph of the carbon dioxide content in off-gas from a retort per ton of oil shale retorted. This value is plotted against the average maximum temperature during a given period of time in the retort. Again, a correlation is shown between carbon dioxide content in off-gas and the temperature in such a retort.

During these tests, the retort inlet mixture introduced into the retort comprised 20% steam and the remainder air.

In practice of principles of this invention, the temperature of a processing zone advancing through a retort is determined by predicting carbon dioxide content of off-gas from the retort as a function of temperature. Then, the carbon dioxide content of off-gas withdrawn from the retort is measured by using a mass spectrometer, gas chromatograph, or other like monitoring means and the measured value is compared to predicted values for determining the temperature of the processing zone. The term "carbon dioxide content" as used herein is intended to include either the concentration of carbon dioxide in off-gas or the total quantity or amount of carbon dioxide in the off-gas.

Details of a method and apparatus used for analyzing off-gas from an underground in situ combustion process, including the determination of carbon dioxide content, can be found in U.S. Pat. No. 3,454,365, by Lumpkin et al, which is incorporated herein by this reference.

The "temperature of the processing zone" referred to herein is a weighted average temperature throughout the entire processing zone and the retort. However, the maximum temperature to which carbonates in the oil shale are subjected has a much greater influence of the amount of decomposition than lower temperatures in the processing zone. Therefore, the temperature determined by practice of this invention can be considered to approximate the maximum temperature of the processing zone. The maximum temperature of the processing zone is the temperature of the combustion zone.

Referring again to FIG. 1, there is an access tunnel, adit, drift, or the like in communication with the bottom of the retort 10. The drift 20 contains a sump 22 in which liquid products, including water and liquid hydrocarbon products, are collected to be withdrawn. The effluent, or off-gas, containing, for example, gaseous products, combustion gas, carbonate decomposition products such as carbon dioxide, and any unreacted gaseous portion of the retort inlet mixture is also withdrawn from the in situ retort by way of the drift 20. The liquid products and effluent gas are withdrawn from the retort as effluent fluids.

As mentioned above, when correlating carbon dioxide content of withdrawn off-gas from a retort with the temperature of a processing zone advancing through the retort, several variables can be considered.

Although it has been found that in some portions of the western United States, such as the Piceance Creek Basin in Colorado, carbonates are fairly uniformly distributed in oil shale, this is not the case in all locations. For example, oil shale can be horizontally bedded in strata of differing inorganic carbonate content due to its sedimentary nature. Layers of formation particles in the fragmented mass correspond to strata in unfragmented formation because there is little vertical mixing between strata when formation is explosively expanded to form an in situ oil shale retort. The processing zone is advanced through the retort in a direction that is generally perpendicular to the planes of the layers in the fragmented mass. As the processing zone advances through the fragmented mass, it encounters layers of particles of differing inorganic carbonate content. The content of carbon dioxide in off-gas from the retort is a function of the inorganic carbonate content of the layer of formation particles through which the processing zone is advancing.

The content of carbon dioxide in off-gas is also a function of the relative proportions of different carbonates and mineral forms of carbonates present in the layer of particles through which the processing zone is advancing. For example, magnesium carbonate decomposes at a higher rate than calcium carbonate at a given temperature. The ratio of magnesium to calcium atoms in dolomitic carbonates can affect the overall rate of carbonate decomposition. Additionally, it has been found that the presence of iron in a magnesium carbonate or dolomitic carbonate can lower the temperature of decomposition and increase the rate of decomposition of such carbonates.

The grade of oil shale in a layer undergoing retorting, or in a layer undergoing combustion, or both, can also affect the carbon dioxide content of off-gas withdrawn from the retort. The grade of oil shale in a layer of particles being retorted can affect carbon dioxide content of off-gas since the content of inorganic carbonates in the raw shale is decreased as the Fischer assay is increased and carbon dioxide from carbonate decomposition is also diluted by gaseous products of retorting.

The porosity of the retorted oil shale is also affected by the oil shale grade because when kerogen in oil shale is decomposed during retorting and is driven out of the particles, minute pores and voids are created. The permeability of the retorted particles can affect the rate and extent of carbonate decomposition during the combustion of carbonaceous residues in the combustion zone. This can be accomplished both by affecting the rate of heat transfer into the particle and by affecting the rate of diffusion of carbon dioxide out of the particle.

Core samples of various strata through the retort can be taken before initiating retorting of oil shale and assays can be conducted to determine carbonate composition, amount of carbonates, and grade of oil shale and the like for regions, i.e., for layers, of the fragmented permeable mass. Such samples can be taken from within the fragmented mass, from formation in the retort site before explosive expansion, or from formation nearby the fragmented mass, since little change in content occurs over large horizontally extending areas of formation.

The carbon dioxide content of off-gas can also be affected by the composition and the rate of introduction of a retort inlet mixture into the retort. Such a retort inlet mixture can contain varying quantities of oxygen and other gases, such as nitrogen and steam. Oxygen in the retort inlet mixture combines with the carbonaceous residues in the combustion zone to form carbon dioxide, carbon monoxide, and other combusted products. The proportions of inert gas, such as nitrogen and condensible gases, such as steam, in the retort inlet mixture can affect the extent to which carbon dioxide produced by combustion, or by carbonate decomposition in the combustion zone, is diluted in the off-gas.

Further, it has been found that the presence of steam in the inlet mixture increases the rate of inorganic carbonate decomposition. Thus, the retort inlet mixture can affect both the total amount of carbon dioxide produced in the retort and the concentration of carbon dioxide in off-gas withdrawn from the retort.

The retort inlet mixture can also include an off-gas recycled from the same retort or another retort. Such off-gas can include a substantial proportion, for example, up to 30 volume percent or more, of carbon dioxide.

The rate of advancement of the combustion zone through the fragmented mass, which can be affected by the composition and rate of introduction of retort inlet mixture, as well as by the grade of oil shale being processed, can affect the time during which particles in the fragmented mass are heated to a sufficient temperature for carbonate decomposition and thus can affect the extent of carbonate decomposition. The particle sizes and distribution of particles in the retort likewise affect the extent of carbonate decomposition.

Another factor which can affect the carbon dioxide content of off-gas is the presence of a secondary combustion zone in the retort. The term "secondary combustion zone" as used herein refers to that portion of the fragmented mass of formation particles where fuel in a retort inlet mixture is consumed.

U.S. Pat. No. 4,191,251 provides additional details relating to establishment and maintenance of secondary combustion zones in an in situ oil shale retort and is incorporated herein by this reference.

Such a secondary combustion zone can generate carbon dioxide, both by combustion and by further decomposition of inorganic carbonates in the secondary combustion zone.

As described above, the composition of the fragmented mass of formation particles can vary at different elevations in the retort. Therefore, the location of the processing zone in the retort is a factor in determining the predicted amount of carbon dioxide in the off-gas.

A variety of techniques can be used to monitor the locus of a processing zone as it passes through a retort. Exemplary of such techniques are methods described in U.S. Pat. Nos. 4,082,145; 4,148,529; 4,150,722; 4,151,877; 4,162,706; and 4,166,721. These patents are all incorporated herein by this reference.

The technique for determining the locus of a processing zone described in U.S. Pat. No. 4,148,529, for example, comprises placing indicator means at a selected location in formation within boundaries of an in situ oil shale retort providing an indicator at a predetermined temperature greater than ambient. Then, formation within the boundaries of the retort to be formed is explosively expanded to form a retort containing a fragmented permeable mass of formation particles containing oil shale and the indicator-providing means. A processing zone is formed in and advanced through the fragmented mass to form at least one effluent fluid and to provide indicator from the indicator-providing means. Such an effluent fluid from the retort is monitored for presence of indicator to determine the locus of the processing zone.

A plurality of indicator-providing means can be provided at a plurality of selected locations spaced apart from each other for monitoring the locus of the processing zone. Such indicator-providing means can be spaced apart from each other along the direction of advancement of the processing zone for monitoring the locus of the processing zone as it advances through the fragmented permeable mass. In addition, such indicator-providing means can be spaced apart from each other in a plane substantially perpendicular or normal to the direction of advancement of a processing zone for determining if the processing zone is skewed and/or warped.

Any or all of the above mentioned factors can be taken into consideration in achieving a correlation between the temperature of the processing zone and the carbon dioxide content of off-gas withdrawn from the in situ oil shale retort.

As such, once the composition of a selected layer of formation is known, and thus the presence, amount, and type of inorganic carbonates in that layer are known, and the other above described variables are taken into consideration, then the concentration of carbon dioxide in the off-gas as a function of the temperature of a processing zone passing through such a layer can be predicted.

The prediction can be made, if desired, using a computer approximation based on thermodynamic principles. Similarly, a laboratory model of an in situ retort can be constructed and tests run to predict concentrations of carbon dioxide in off-gas as a function of the temperature in the retort. Still another method for predicting the content of carbon dioxide in retort off-gas as a function of temperature is using an in situ oil shale retort having approximately the same elevations as the retort to be processed. Instruments can be used to measure actual temperatures to provide a correlation with carbon dioxide content to serve as a prediction tool for subsequent retorts.

Retorting of oil shale can be conducted with combustion zone temperatures as low as about 800° F. However, for economically efficient retorting, it is preferred to maintain the combustion zone temperature at least about 1100° F. The upper limit desirable for the combustion zone temperature can be determined by a number of variables, as described above, with a maximum desirable temperature being less than the fusion temperature of oil shale, i.e., less than about 2100° F. The temperature of the combustion zone preferably is maintained below about 1800° F. to provide a margin of safety between the temperature of the combustion zone and the fusion temperature of oil shale.

In an exemplary embodiment, formation particles in the retort 10 comprise approximately 8 to 12 weight percent calcium and about 1.5 to about 3 weight percent magnesium as carbonates. The temperature of the combustion zone is desirably maintained between about 1100° F. and about 1800° F. Therefore, during the retorting operation of the exemplary retort 10, carbonates such as calcite and dolomite and the like, present in the formation particles, are at least partially calcined to produce alkaline earth metal oxides and carbon dioxide.

The formation 14 is sampled to determine the composition of selected layers of the fragmented mass of formation particles and the locus of the processing zone within the retort is determined. By taking the locus of the processing zone into account along with the other variables described above, carbon dioxide content of off-gas from the retort is predicted as a function of temperature. Off-gas is withdrawn from the retort and monitored to determine its carbon dioxide content. The determined carbon dioxide content of the off-gas is compared to values predicted as a function of temperature to determine the temperature of the processing zone.

Determining the temperature of a processing zone in an in situ oil shale retort by practice of principles of this invention has a number of advantages. There is no need to place instruments or probes within the retort itself. The carbon dioxide content of off-gas can be readily determined by a variety of well known chemical and instrumental methods. Further, off-gas moves fairly rapidly through the retort so that even when a combustion zone is near the upper end of the retort; that is, 200 or even 300 feet above the retort outlet, carbon dioxide generated in the combustion zone can appear in off-gas withdrawn at the bottom of the retort in an hour or so. Thus, any changes in the temperature of the combustion zone will be relatively quickly reflected in changes in the carbon dioxide content of off-gas withdrawn from the retort.

The above description of a method for determining the temperature of a processing zone in an in situ oil shale retort in a subterranean formation containing oil shale is for illustrative purposes. Because of variations which will be apparent to those skilled in the art, the present invention is not intended to be limited to the particular embodiments described hereinabove. The scope of the invention is defined in the following claims.

What is claimed is:

1. A method for determining the temperature of a processing zone in a fragmented permeable mass of formation particles in an in situ oil shale retort in a subterranean formation, the subterranean formation comprising kerogen and inorganic carbonates, the method comprising the steps of:

(a) forming an in situ oil shale retort containing a fragmented permeable mass of formation particles comprising kerogen and inorganic carbonates in the subterranean formation;

(b) advancing a processing zone through the fragmented permeable mass of formation particles for producing liquid and gaseous products from the kerogen, at least a portion of such inorganic carbonates being decomposed in the processing zone, forming inorganic oxides and gaseous carbon dioxide;

(c) withdrawing off-gas, including carbon dioxide from carbonate decomposition, from the retort on the advancing side of the processing zone, the carbon dioxide content of the withdrawn off-gas being a function of the temperature of the processing zone;

(d) determining the carbon dioxide content of the withdrawn off-gas; and (e) correlating the carbon dioxide content of the withdrawn off-gas with the temperature of the processing zone.

2. The method according to claim 1 wherein the processing zone comprises a combustion zone.

3. The method according to claim 1 wherein the processing zone comprises a retorting zone.

4. A method for determining the temperature of a processing zone in a fragmented permeable mass of formation particles in an in situ oil shale retort in a subterranean formation, the subterranean formation comprising kerogen and inorganic carbonates, the method comprising the steps of:

(a) forming an in situ oil shale retort containing a fragmented permeable mass of formation particles comprising keorgen and inorganic carbonates in the subterranean formation;

(b) sampling formation to determine the type and amount of inorganic carbonates present in the fragmented permeable mass of formation particles at selected elevations in the oil shale retort;

(c) advancing a processing zone through the fragmented permeable mass of formation particles for producing liquid and gaseous products from the kerogen, at least a portion of such inorganic carbonates being decomposed in the processing zone, forming inorganic oxides and gaseous carbon dioxide;

(d) withdrawing off-gas, including carbon dioxide from carbonate decomposition, from the retort on the advancing side of the processing zone, the carbon dioxide content of withdrawn off-gas being a function of the temperature of the processing zone;

(e) predicting the carbon dioxide content of such withdrawn off-gas as a function of the temperature of the processing zone at such selected elevations in the retort;

(f) determining the locus of the processing zone;

(g) determining the carbon dioxide content of the withdrawn off-gas; and (h) correlating the carbon dioxide content of the withdrawn off-gas with the temperature of the processing zone.

5. The method according to claim 4 wherein the processing zone comprises a combustion zone.

6. The method according to claim 4 wherein the processing zone comprises a retorting zone.

7. A method for determining the temperature of a combustion zone in a fragmented permeable mass of formation particles in an in situ oil shale retort in a subterranean formation comprising kerogen and inorganic carbonates, the method comprising the steps of:

(a) forming an in situ oil shale retort in a subterranean formation, the in situ oil shale retort containing a fragmented permeable mass of formation particles comprising kerogen and inorganic carbonates;

(b) forming a combustion zone in the fragmented permeable mass;

(c) introducing a retort inlet mixture comprising an oxygen-supplying gas for advancing the combustion zone through the retort for forming a retorting zone on the advancing side of the combustion zone for producing liquid and gaseous products from the kerogen, at least a portion of such inorganic carbonates being decomposed in the combustion zone forming inorganic oxides and gaseous carbon dioxide;

(d) withdrawing off-gas, including carbon dioxide from carbonate decomposition, from the retort on the advancing side of the retorting zone, the carbon dioxide content of the withdrawn off-gas being a function of the temperature of the combustion zone;

(e) predicting the carbon dioxide content of such withdrawn off-gas as a function of the temperature of the combustion zone;

(f) determining the carbon dioxide content of the withdrawn off-gas; and (g) comparing the determined carbon dioxide content of the withdrawn off-gas with carbon dioxide content of off-gas predicted as a function of the temperature of the combustion zone.

8. A method for determining the temperature of a combustion zone in a fragmented permeable mass of formation particles in an in situ oil shale retort in a subterranean formation comprising kerogen and inorganic carbonates, the method comprising the steps of:

(a) forming an in situ oil shale retort in a subterranean formation, the in situ oil shale retort containing a fragmented permeable mass of formation particles comprising kerogen and inorganic carbonates;

(b) sampling formation to determine the type and amount of inorganic carbonates present in the fragmented permeable mass of formation particles at selected elevations in the oil shale retort;

(c) forming a combustion zone in the fragmented permeable mass;

(d) introducing a retort inlet mixture comprising an oxygen-supplying gas for advancing the combustion zone through the retort for forming a retorting zone on the advancing side of the combustion zone for producing liquid and gaseous products from the kerogen, at least a portion of such inorganic carbonates being decomposed in the combustion zone forming inorganic oxides and gaseous carbon dioxide;

(e) withdrawing off-gas, including carbon dioxide from carbonate decomposition, from the retort on the advancing side of the retorting zone, the carbon dioxide content of withdrawn off-gas being a function of the temperature of the combustion zone;

(f) predicting the carbon dioxide content of such withdrawn off-gas as a function of the temperature of the combustion zone at such selected elevations in the retort;

(g) determining the locus of the combustion zone;

(h) determining the carbon dioxide content of the withdrawn off-gas; and (i) comparing the determined carbon dioxide content of the withdrawn off-gas with carbon dioxide content of off-gas predicted as a function of the temperature of the combustion zone.

9. A method for determining the temperature of a combustion zone in a fragmented permeable mass of formation particles in an in situ oil shale retort in a subterranean formation comprising kerogen and inorganic carbonates, the method comprising the steps of:

(a) forming an in situ oil shale retort in a subterranean formation, the in situ oil shale retort containing a fragmented permeable mass of formation particles comprising kerogen and inorganic carbonates;

(b) forming a combustion zone in the fragmented permeable mass;

(c) introducing a retort inlet mixture comprising an oxygen-supplying gas for advancing the combustion zone through the retort for forming a retorting zone on the advancing side of the combustion zone for producing liquid and gaseous products from the kerogen, at least a portion of such inorganic carbonates being decomposed in the combustion zone forming inorganic oxides and gaseous carbon dioxide;

(d) withdrawing off-gas, including carbon dioxide from carbonate decomposition, from the retort on the advancing side of the retorting zone, the carbon dioxide content of such withdrawn off-gas per unit of oxygen in such oxygen-supplying gas in the retort inlet mixture being a function of the temperature of the combustion zone;

(e) predicting the carbon dioxide content of such withdrawn off-gas per unit of oxygen in such oxygen-supplying gas in the retort inlet mixture, as a function of the temperature of the combustion zone;

(f) determining the carbon dioxide content of the withdrawn off-gas per unit of oxygen in such oxygen-supplying gas in the retort inlet mixture; and (g) comparing the determined carbon dioxide content of the withdrawn off-gas per unit of oxygen in such oxygen-supplying gas in the retort inlet mixture with a predicted carbon dioxide content in withdrawn off-gas per unit of oxygen in such oxygen-supplying gas in the retort inlet mixture as a function of the temperature of the combustion zone.

10. A method for determining the temperature of a combustion zone in a fragmented permeable mass of formation particles in an in situ oil shale retort in a subterranean formation comprising kerogen and inorganic carbonates, the method comprising the steps of:

(a) forming an in situ oil shale retort in a subterranean formation, the in situ oil shale retort containing a fragmented permeable mass of formation particles comprising kerogen and inorganic carbonates;

(b) sampling formation to determine the type and amount of inorganic carbonates present in the fragmented permeable mass of formation particles at selected elevations in the oil shale retort;

(c) forming a combustion zone in the fragmented permeable mass;

(d) introducing a retort inlet mixture comprising an oxygen-supplying gas for advancing the combustion zone through the retort for forming a retorting zone on the advancing side of the combustion zone for producing liquid and gaseous products from the kerogen, at least a portion of such inorganic carbonates being decomposed in the combustion zone forming inorganic oxides and gaseous carbon dioxide;

(e) withdrawing off-gas, including carbon dioxide from carbonate decomposition, from the retort on the advancing side of the retorting zone, the carbon dioxide content of such withdrawn off-gas per unit of oxygen in such oxygen-supplying gas in the retort inlet mixture being a function of the temperature of the combustion zone;

(f) predicting the carbon dioxide content of such withdrawn off-gas per unit of oxygen in such oxygen-supplying gas in the retort inlet mixture as a function of the temperature of the combustion zone at such selected elevations in the retort;

(g) determining the locus of the combustion zone;

(h) determining the carbon dioxide content of the withdrawn off-gas per unit of oxygen in such oxygen-supplying gas in the retort inlet mixture; and (i) comparing the determined carbon dioxide content of the withdrawn off-gas per unit of oxygen in such oxygen-supplying gas in the retort inlet mixture with a predicted carbon dioxide content in withdrawn off-gas per unit of oxygen in such oxygen-supplying gas in the retort inlet mixture as a function of the temperature of the combustion zone.

11. A method for determining the temperature of a combustion zone in a fragmented permeable mass of formation particles in an in situ oil shale retort in a subterranean formation comprising kerogen and inorganic carbonates, the method comprising the steps of:

(a) forming an in situ oil shale retort in a subterranean formation, the in situ oil shale retort containing a fragmented permeable mass of formation particles comprising kerogen and inorganic carbonates;

(b) forming a combustion zone in the fragmented permeable mass;

(c) introducing a retort inlet mixture comprising an oxygen-supplying gas for advancing the combustion zone through the retort for forming a retorting zone on the advancing side of the combustion zone for producing liquid and gaseous products from the kerogen, at least a portion of such inorganic carbonates being decomposed in the combustion zone, forming inorganic oxides and gaseous carbon dioxide;

(d) withdrawing off-gas, including carbon dioxide from carbonate decomposition, from the retort on the advancing side of the retorting zone, the amount of carbon dioxide in such withdrawn off-gas per ton of oil shale retorted being a function of the temperature of the combustion zone;

(e) predicting the amount of carbon dioxide in such withdrawn off-gas per ton of oil shale retorted as a function of the temperature of the combustion zone;

(f) determining the amount of carbon dioxide in the withdrawn off-gas per ton of oil shale retorted; and (g) comparing the determined amount of carbon dioxide in the withdrawn off-gas per ton of oil shale retorted with a predicted amount of carbon dioxide in withdrawn off-gas per ton of oil shale retorted as a function of the temperature of the combustion zone.

12. A method for determining the temperature of a combustion zone in a fragmented permeable mass of formation particles in an in situ oil shale retort in a subterranean formation comprising kerogen and inorganic carbonates, the method comprising the steps of:

(a) forming an in situ oil shale retort in a subterranean formation, the in situ oil shale retort containing a fragmented permeable mass of formation particles comprising kerogen and inorganic carbonates;

(b) sampling formation to determine the type and amount of inorganic carbonates present in the fragmented permeable mass of formation particles at selected elevations in the oil shale retort;

(c) forming a combustion zone in the fragmented permeable mass;

(d) introducing a retort inlet mixture comprising an oxygen-supplying gas for advancing the combustion zone through the retort for forming a retorting zone on the advancing side of the combustion zone for producing liquid and gaseous products from the kerogen, at least a portion of such inorganic carbonates being decomposed in the combustion zone, forming inorganic oxides and gaseous carbon dioxide;

(e) withdrawing off-gas, including carbon dioxide from carbonate decomposition, from the retort on the advancing side of the retorting zone, the amount of carbon dioxide in such withdrawn off-gas per ton of oil shale retorted being a function of the temperature of the combustion zone;

(f) predicting the amount of carbon dioxide in such withdrawn off-gas per ton of oil shale retorted as a function of the temperature of the combustion zone at such selected elevations in the retort;

(g) determining the locus of the combustion zone;

(h) determining the amount of carbon dioxide in the withdrawn off-gas per ton of oil shale retorted; and (i) comparing the determined amount of carbon dioxide in the withdrawn off-gas per ton of oil shale retorted with a predicted amount of carbon dioxide in withdrawn off-gas per ton of oil shale retorted as a function of the temperature of the combustion zone.

13. A method for determining the temperature of a processing zone in a fragmented permeable mass of formation particles in an in situ oil shale retort in a subterranean formation comprising kerogen and inorgnic carbonates, the method comprising the steps of:

(a) forming an in situ oil shale retort in a subterranean formation, the in situ oil shale retort containing a fragmented permeable mass of formation particles comprising kerogen and inorganic carbonates;

(b) advancing a processing zone through the fragmented permeable mass of formation particles for producing liquid and gaseous products from the kerogen, at least a portion of such inorganic carbonates being decomposed in the processing zone forming inorganic oxides and gaseous carbon dioxide;

(c) determining the locus of the processing zone;

(d) withdrawing off-gas including carbon dioxide from carbonate decomposition from the retort, the carbon dioxide content of withdrawn off-gas being a function of the temperature and locus of the processing zone;

(e) predicting the carbon dioxide content of such withdrawn off-gas as a function of the temperature and locus of the processing zone;

(f) determining the carbon dioxide content of the withdrawn off-gas; and (g) correlating the carbon dioxide content of the withdrawn off-gas with a temperature of the processing zone having the determined locus.

14. The method according to claim 13 wherein the processing zone comprises a combustion zone.

15. A method for determining the temperature of a processing zone in a fragmented permeable mass of formation particles in an in situ oil shale retort in a subterranean formation comprising kerogen and inorganic carbonates, the method comprising the steps of:

(a) forming an in situ oil shale retort in a subterranean formation, the in situ oil shale retort containing a fragmented permeable mass of formation particles comprising kerogen and inorganic carbonates;

(b) determining the composition of the fragmented permeable mass of formation particles;

(c) advancing a processing zone through the fragmented permeable mass of formation particles for producing liquid and gaseous products from the kerogen, at least a portion of such inorganic carbonates being decomposed in the processing zone forming inorganic oxides and gaseous carbon dioxide;

(d) determining the locus of the processing zone;

(e) withdrawing off-gas including carbon dioxide from carbonate decomposition from the retort, the carbon dioxide content of withdrawn off-gas being a function of the temperature and locus of the processing zone;

(f) predicting the carbon dioxide content of such withdrawn off-gas as a function of the temperature and locus of the processing zone;

(g) determining the carbon dioxide content in the withdrawn off-gas; and (h) correlating the carbon dioxide content of the withdrawn off-gas with the temperature of the processing zone having the determined locus.

* * * * *